US008761429B2

(12) United States Patent
Stephenson

(10) Patent No.: US 8,761,429 B2
(45) Date of Patent: Jun. 24, 2014

(54) AUDIO HEADSETS WITH MULTI-COLOR RIBBON CABLE AND RELATED SYSTEMS AND METHODS OF MANUFACTURE

(75) Inventor: Shawn M. Stephenson, Durham, NC (US)

(73) Assignee: HTC Corporation, Taoyuan City, Taoyuan County (TW)

( * ) Notice: Subject to any disclaimer, the term of this patent is extended or adjusted under 35 U.S.C. 154(b) by 92 days.

(21) Appl. No.: 13/425,465

(22) Filed: Mar. 21, 2012

(65) Prior Publication Data

US 2013/0077815 A1 Mar. 28, 2013

Related U.S. Application Data

(60) Provisional application No. 61/540,370, filed on Sep. 28, 2011.

(51) Int. Cl.
*H04R 1/10* (2006.01)

(52) U.S. Cl.
USPC ..... 381/384; 381/370; 174/112; 174/117 F

(58) Field of Classification Search
USPC ..... 381/370, 384; 174/117 F, 112; 385/114, 385/128
See application file for complete search history.

(56) References Cited

U.S. PATENT DOCUMENTS 3,082,292 A * 3/1963 Gore ..... 174/117 F
3,260,689 A * 7/1966 Kibler et al. ..... 524/398
3,540,956 A * 11/1970 Arnold et al. ..... 156/54
3,594,228 A * 7/1971 Mock ..... 427/118
3,720,747 A * 3/1973 Anderson et al. ..... 264/246
4,171,860 A * 10/1979 Katz ..... 439/623
4,538,024 A * 8/1985 Wise et al. ..... 174/117 F
4,620,605 A 11/1986 Gore et al.
4,870,688 A 9/1989 Voroba et al.
5,304,741 A * 4/1994 Proulx ..... 174/117 FF
6,498,881 B1 * 12/2002 Thompson et al. ..... 385/114
8,068,633 B2 11/2011 Lee et al.
D660,289 S 5/2012 Lee et al.
8,363,876 B2 1/2013 Miskiel et al.
2003/0016924 A1 * 1/2003 Thompson et al. ..... 385/114

(Continued)

FOREIGN PATENT DOCUMENTS

DE 1404370 A 1/1969

OTHER PUBLICATIONS

German Office Action dated Jun. 3, 2013.

*Primary Examiner* — Curtis Kuntz
*Assistant Examiner* — Joshua A Kaufman
(74) *Attorney, Agent, or Firm* — McClure, Qualey & Rodack, LLP

(57) ABSTRACT

Headsets with multi-color ribbon cable and related systems and methods of manufacture are provided. A representative audio headset includes: a ribbon cable having a body and multiple elongated conductors, the body being formed of electrically insulating material and extending between a connector end an earpiece end, the body having a first side and an opposing second side, the insulating material exhibiting a first color, the multiple elongated conductors being embedded in the body; a connector attached to the connector end and electrically coupled to the conductors; an earpiece connected to the earpiece end and electrically coupled to the conductors; and dye bonded with the insulating material at the second side of the body such that the second side of the body exhibits a second color different from the first color.

10 Claims, 5 Drawing Sheets

(56) References Cited

U.S. PATENT DOCUMENTS

| | | | | |
|---|---|---|---|---|
| 2005/0084224 | A1* | 4/2005 | Greer et al. | 385/128 |
| 2009/0190786 | A1 | 7/2009 | Miskiel et al. | |
| 2009/0214069 | A1 | 8/2009 | Plummer | |
| 2010/0027831 | A1* | 2/2010 | Lee et al. | 381/384 |
| 2010/0316229 | A1 | 12/2010 | Bibl et al. | |
| 2012/0224737 | A1 | 9/2012 | Cataldo et al. | |
| 2012/0224738 | A1 | 9/2012 | Cataldo et al. | |

* cited by examiner

AUDIO HEADSETS WITH MULTI-COLOR RIBBON CABLE AND RELATED SYSTEMS AND METHODS OF MANUFACTURE

CROSS-REFERENCE TO RELATED APPLICATION

This application is a utility application that claims priority to co-pending U.S. Provisional Patent Application entitled, "METHOD FOR CREATING A MULTIPLE COLOR RIBBON CABLE FOR AUDIO HEADSETS", having Ser. No. 61/540,370, filed Sep. 28, 2011, which is entirely incorporated herein by reference.

TECHNICAL FIELD

The present disclosure generally relates to audio headsets.

BACKGROUND

Various electronic devices use headsets for improving privacy during use. Oftentimes, headsets incorporate ribbon cables, which are relatively flat cables that include several conductors configured in a side-by-side arrangement.

In the past, the individual conductors of a ribbon cable were separately insulated and could exhibit multiple colors owing to the different colors of the insulating materials. More recently, however, the conductors are simultaneously coated with insulating material. Thus, ribbon cables exhibiting a single color are often provided.

SUMMARY

Briefly described, one embodiment, among others, is an audio headset comprising: a ribbon cable having a body and multiple elongated conductors, the body being formed of electrically insulating material and extending between a connector end an earpiece end, the body having a first side and an opposing second side, the insulating material exhibiting a first color, the multiple elongated conductors being embedded in the body; a connector attached to the connector end and electrically coupled to the conductors; an earpiece connected to the earpiece end and electrically coupled to the conductors; and dye bonded with the insulating material at the second side of the body such that the second side of the body exhibits a second color different from the first color.

Another embodiment is a method for manufacturing a headset comprising: providing a ribbon cable having a first side and a second side; using dye sublimation to alter a color of the second side of the ribbon cable; and forming a headset with the ribbon cable.

Another embodiment is a system for manufacturing ribbon cable comprising: a conductor feed section; a ribbon cable forming section, positioned downstream of the conductor feed section, operative to coat the conductors with insulating material to form a ribbon cable assembly; and a dye sublimation section, positioned downstream of the cable forming section, operative to dye a side of the ribbon cable assembly.

Other systems, methods, features, and advantages of the present disclosure will be or may become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
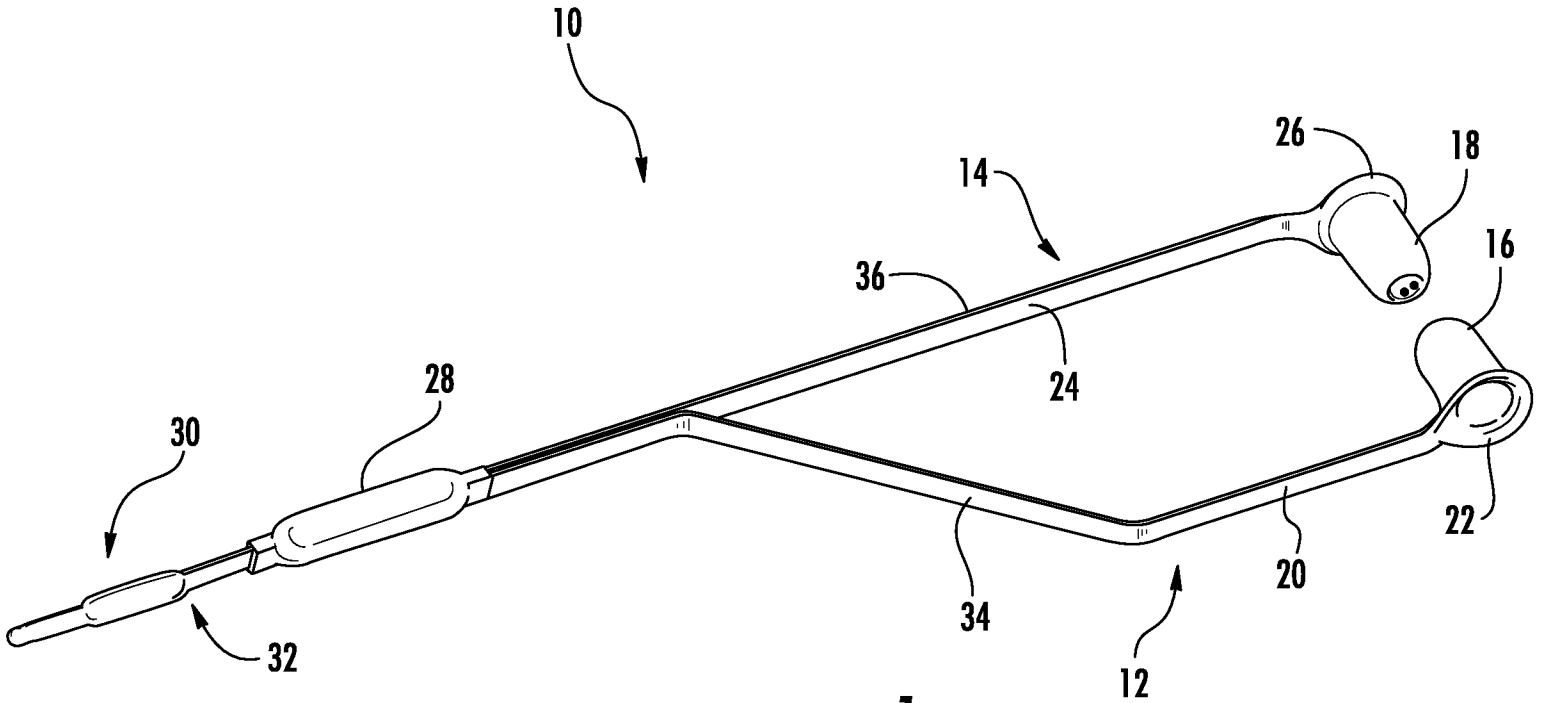
FIG. 1 is a schematic diagram depicting an example embodiment of an audio headset.

Having summarized various aspects of the present disclosure, reference will now be made in detail to that which is illustrated in the drawings. While the disclosure will be described in connection with these drawings, there is no intent to limit the scope of legal protection to the embodiment or embodiments disclosed herein. Rather, the intent is to cover all alternatives, modifications and equivalents included within the spirit and scope of the disclosure as defined by the appended claims.

Audio headsets with multi-color ribbon cable and related systems and methods of manufacture are provided. In some embodiments, the ribbon cable of a headset exhibits a first color and a second color, with the second color often being disposed on a single face of the cable. Notably, the second color can be deposited by dye sublimation, which bonds dye to polymer chains of the insulating material of the cable by use of heat and pressure. In some embodiments, multiple sets of conductors can be coated with insulating material simultaneously, and then the sets can be simultaneously colored by dye sublimation to from the ribbon cable. Thereafter, the sets can be separated from each other to form multiple multi-color ribbon cables.

In this regard, FIG. 1 is a schematic diagram depicting an example embodiment of an audio headset. As shown in FIG. 1, headset 10 includes earpiece assemblies 12 and 14, with each terminating in an earpiece (16, 18).

Earpiece assembly 12 includes a ribbon cable portion 20 terminating in an earpiece end 22, and earpiece assembly 14 includes a ribbon cable portion 24 terminating in an earpiece end 26. Each of the ribbon cable portions incorporates a body and multiple elongated conductors embedded within the body (not shown in FIG. 1). The conductors within the respective ribbon cable portions are electrically connected to the corresponding earpieces. Notably, each body is formed of electrically insulating material. By way of example, the insulating material can be PVC, TPE, silicone or rubber, among others. In this embodiment, each body is generally rectangular in cross-section.

The ribbon cable portions are joined at their respective proximal ends to a control box 28, which may provide various functions such as volume control, for example. The conductors exit the control box and attach to a connector 30 at their connector end 32. The connector, which is used to engage an audio receptacle (not shown), is electrically coupled to the conductors of the ribbon cable portions.

Of particular interest in the embodiment of FIG. 1 is the arrangement of dye bonded with the insulating material of the ribbon cable potions. Specifically, outer sides 34, 36 of the ribbon cable portions have been subjected to dye sublimation so that these sides exhibits colors different from other sides of the ribbon cable portions.

Figure 2:
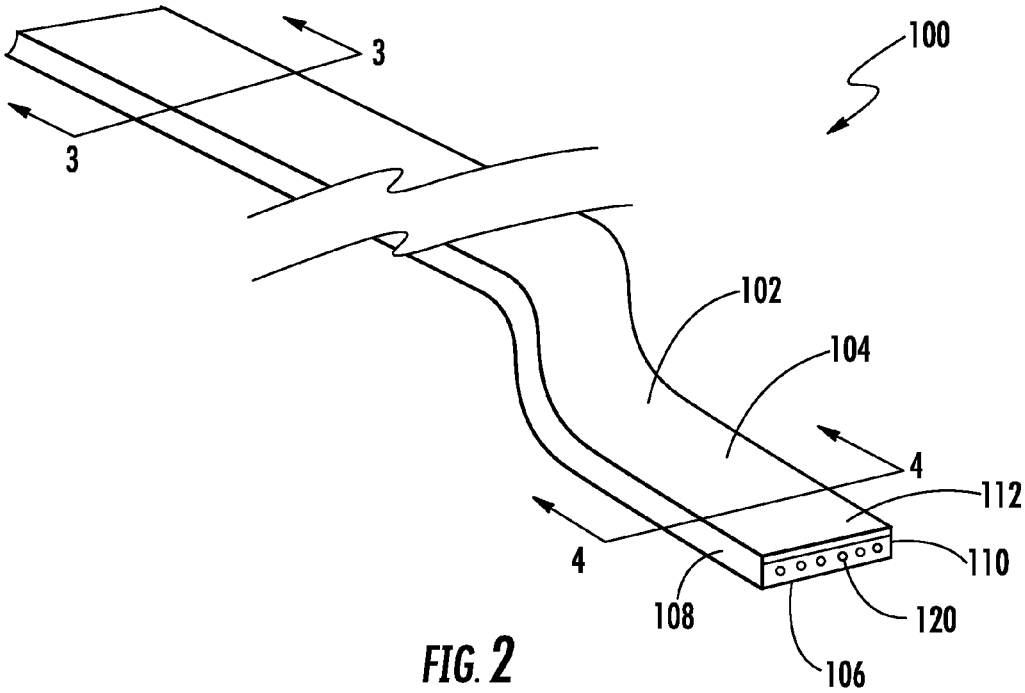
FIG. 2 is a schematic diagram depicting a length of ribbon cable of the embodiment of FIG. 1.

FIG. 2 is a schematic diagram depicting an example embodiment of a length of ribbon cable, over which some of the ribbon cable has been subjected to dye sublimation. As shown in FIG. 2, cable 100 includes a body 102 of electrically insulating material. By way of example, the insulating material can be PVC, TPE, silicone or rubber, among others. In this embodiment, the body is generally rectangular in cross section and includes sides 104, 106, 108 and 110, with sides 104 and 106 opposing each other, and sides 108 and 110 opposing each other.

Embedded within the body are multiple elongated conductors (e.g., conductor 120), with the conductors being oriented in a side-by-side arrangement across a width of the body. A layer of dye 112 is bonded to the insulating material. In particular, in this embodiment, the dye is bonded to side 104, which corresponds to a width of the cable. The dye, which is bonded to the insulating material by dye sublimation, forms a colored portion of the cable that can exhibit a different color than that of the remainder of the body.

Figure 3:
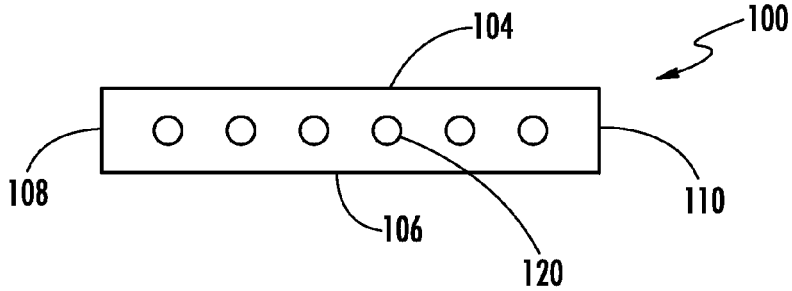
FIG. 3 is a cross-sectional view of the embodiment of FIG. 2, taken along line 3-3.
Figure 4:
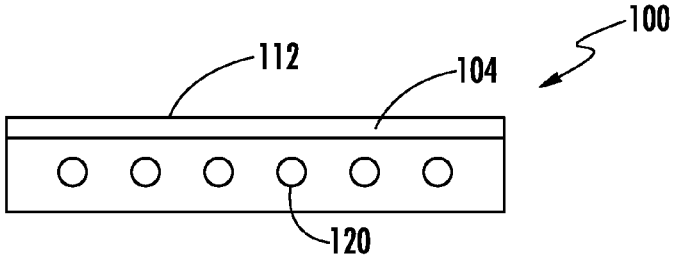
FIG. 4 is a cross-sectional view of the embodiment of FIG. 2, taken along line 4-4.

It should be noted that ribbon cable 100 of this embodiment is formed by a continuous dye process such that the portion of the cable at the left most part of the figure has yet to be dyed and the portion at the right most portion has already been dyed. As such, FIG. 3 represents a cross section of the undyed portion, whereas FIG. 4 represents a cross-section of the dyed portion. Details of an example embodiment of a system for manufacturing ribbon cable in a continuous process will be described later with respect to FIG. 7.

Figure 5:
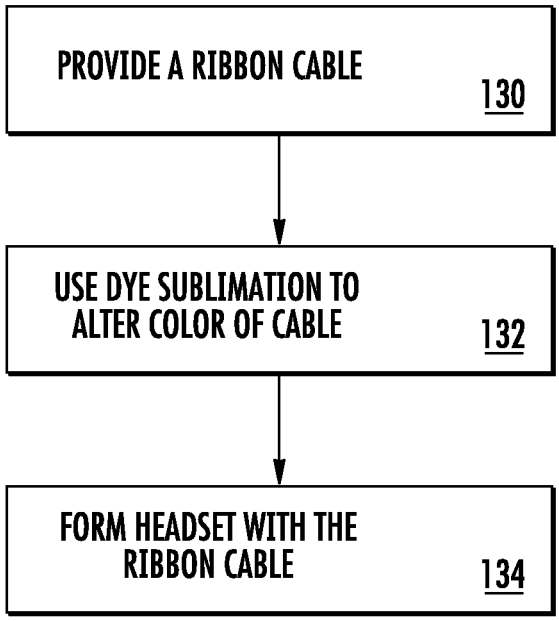
FIG. 5 is a flowchart depicting an example embodiment of a method for manufacturing a headset with ribbon cable.

FIG. 5 is a flowchart depicting an example embodiment of a method for manufacturing a ribbon cable. As shown in FIG. 5, the method includes providing a ribbon cable having a first side and a second side (block 130). In block 132, dye sublimation is used to alter the color of the second side of the ribbon cable. In other embodiments, more than one of the sides can be dyed. It should be noted that in various embodiments, dyed sides of a cable need not use the same color. Moreover, along a given length and/or width of cable, dye colors can change in some embodiments to form various color combinations or patterns. Thus, ribbon cables exhibiting more than two colors can be formed. Thereafter, such as depicted in block 134, a headset is formed using the ribbon cable.

Figure 6:
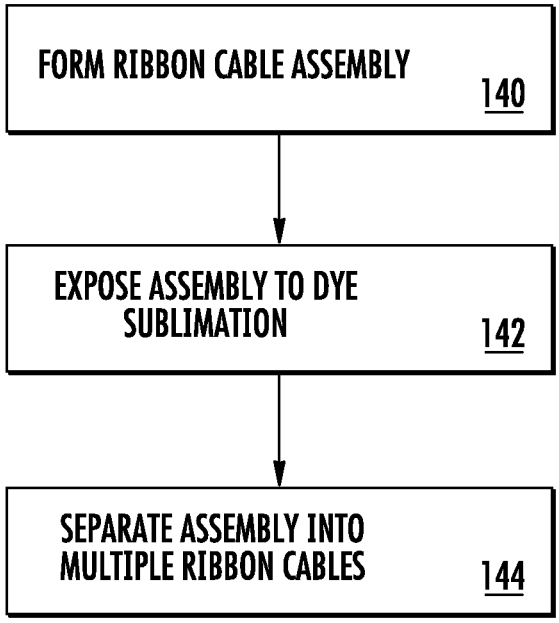
FIG. 6 is a flowchart depicting another example embodiment of a method for manufacturing headset with ribbon cable.

FIG. 6 is a flowchart depicting another example embodiment of a method for manufacturing ribbon cable. As shown in FIG. 6, the method includes forming a ribbon cable assembly (block 140). Notably, a ribbon cable assembly can include multiple sets of conductors, with each of the sets containing enough conductors to form a separate ribbon cable. In block 142, the ribbon cable assembly is exposed to dye sublimation to color at least one side of the assembly. Thereafter, such as depicted in block 144, the assembly is separated into multiple ribbon cables, with each of the ribbon cables including a dyed side.

Figure 7:
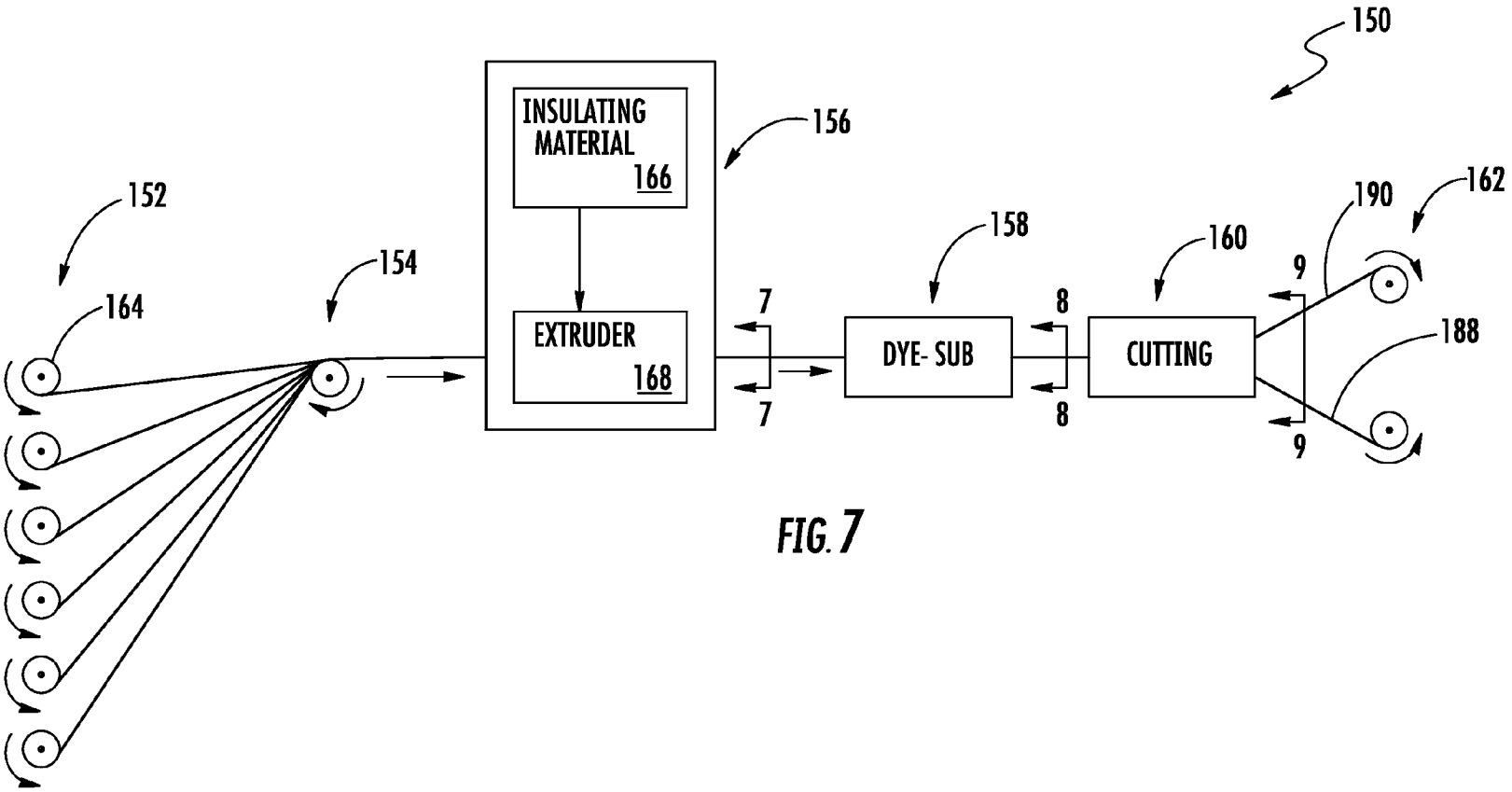
FIG. 7 is a schematic diagram depicting an example system for manufacturing ribbon cable.

FIG. 7 is a schematic diagram depicting an example system for manufacturing ribbon cable such as according to the method shown in FIG. 6. In FIG. 7, system 150 includes a conductor supply section 152, a conductor feed section 154, a ribbon cable forming section 156, a dye sublimation section 158, a cutting section 160 and a ribbon cable supply section 162. Conductor supply section 152 incorporates multiple sources of elongated conductors (e.g., copper wire spool 164) that provide conductors for use in forming a ribbon cable. Conductor feed section 154 receives the supplies of conductors and orients the conductors for further processing. For instance, the feed section establishes the side-by-side configuration and spacing of the conductors.

Ribbon cable forming section 156, which is positioned downstream of the conductor feed section, coats the conductors with insulating material 166 to form a ribbon cable assembly. In this embodiment, an extruder 168 applies the insulating material about the conductors. As mentioned above, in some embodiments, the ribbon cable assembly can include multiple sets of conductors.

Dye sublimation section 158 is positioned downstream of the cable forming section and is operative to dye at least a portion of one side of the ribbon cable assembly. Cutting section 160 is positioned downstream of the dye sublimation section and is operative to separate the ribbon cable assembly into multiple ribbon cables. In this embodiment, the cutting section includes a cutter that separates the sets of conductors longitudinally.

Ribbon cable supply section 162 is positioned downstream of the cutting section and is operative to gather the separated ribbon cables. For instance, this section can include multiple spools, each of which is configured to take-up a corresponding one of the separated ribbon cables.

Figure 8:
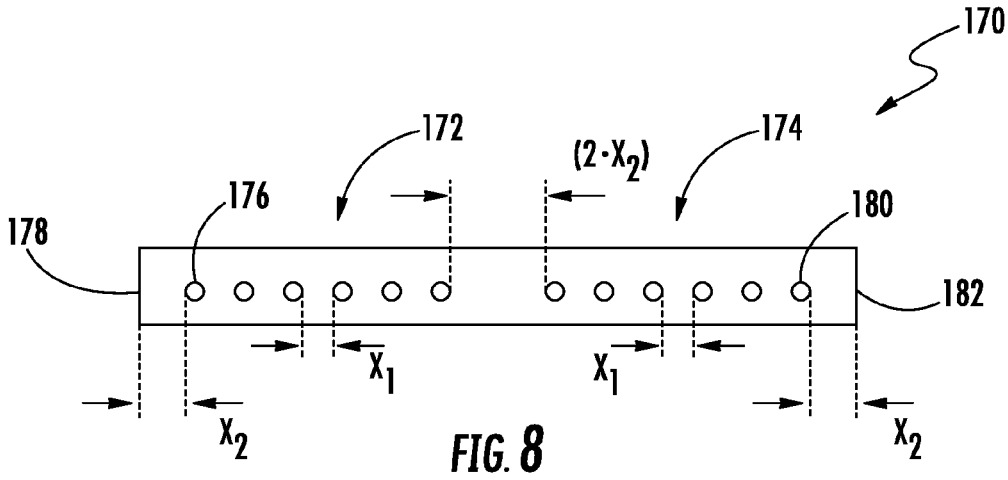
FIG. 8 is a cross-sectional view of the ribbon cable of the embodiment of FIG. 7, taken along line 8-8.

FIG. 8 is a cross-sectional view of the ribbon cable assembly of the embodiment of FIG. 7, taken along line 8-8. Note that in FIG. 8, ribbon cable assembly 170 includes a first set of conductors 172 and a second set of conductors 174, with each of the sets incorporating six conductors. Note that in other embodiments, various other numbers and arrangements of conductors can be used. Within the first set, each of the conductors is spaced from an adjacent conductor by a distance $x_1$, with a distance $x_2$ being the spacing from the outermost conductor 176 to the side 178 of the body. Similarly, within the second set, each of the conductors is spaced from an adjacent conductor by a distance $x_1$, with a distance $x_2$ being the spacing from the outermost conductor 180 to the side 182 of the body. The spacing between the inner most conductor of the first and second sets is twice $x_2$.

Figure 9:
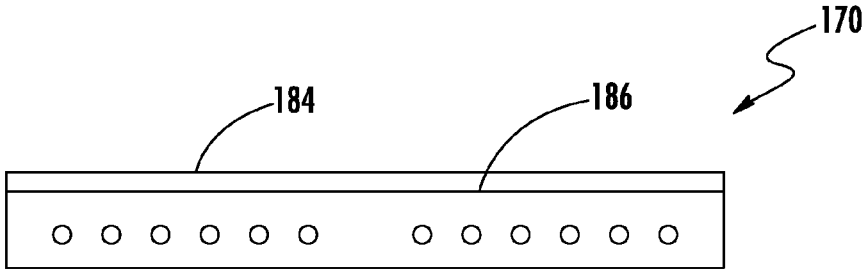
FIG. 9 is a cross-sectional view of the ribbon cable of the embodiment of FIG. 7, taken along line 9-9.

FIG. 9 is a cross-sectional view of the ribbon cable assembly of the embodiment of FIG. 7, taken along line 9-9. As shown in FIG. 7, ribbon cable assembly 170 includes dye 184 on side 186.

Figure 10:
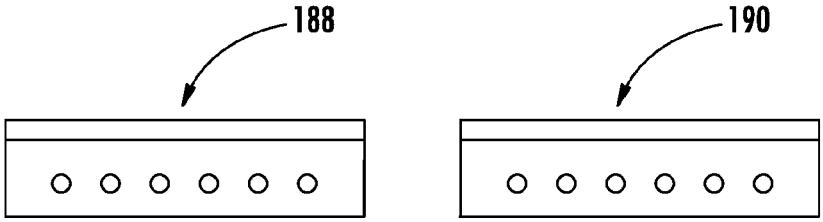
FIG. 10 is a cross-sectional view of the ribbon cable of the embodiment of FIG. 7, taken along line 10-10.

FIG. 10 is a cross-sectional view of the ribbon cable assembly of the embodiment of FIG. 7, taken along line 10-10. Note that in FIG. 10, the assembly has been separated in ribbon cables 188, 190.

It should be emphasized that the above-described embodiments are merely examples of possible implementations. Many variations and modifications may be made to the above-described embodiments without departing from the principles of the present disclosure. By way of example, although the flowcharts show specific orders of execution, it is to be understood that the orders of execution may differ. All such modifications and variations are intended to be included herein within the scope of this disclosure and protected by the following claims.

The invention claimed is:

1. An audio headset comprising:

a ribbon cable having a substantially rectangular body and multiple elongated conductors, the substantially rectangular body being formed of electrically insulating material and extending between a connector end and an earpiece end, the substantially rectangular body having a first substantially flat side and an opposing second substantially flat side, the insulating material exhibiting a first color, the multiple elongated conductors being embedded in the substantially rectangular body;

a connector attached to the connector end and electrically coupled to the multiple elongated conductors;

an earpiece connected to the earpiece end and electrically coupled to the multiple elongated conductors; and a layer of dye that is bonded to the insulating material on the second substantially flat side of the body, the layer of dye overlying the first color exhibited by the insulating material such that the second substantially flat side of the body exhibits a second color different from the first color.

2. The audio headset of claim 1, wherein the layer of dye is bonded to the body only on the second substantially flat side.

3. The audio headset of claim 1, wherein:

the multiple elongated conductors are oriented in a side-by-side arrangement across a width of the substantially rectangular body; and the width of the second substantially flat side corresponds to the width of the substantially rectangular body.

4. The audio headset of claim 1, wherein the layer of dye is bonded to the insulating material using dye sublimation.

5. The audio headset of claim 1, wherein the ribbon cable is separated from a ribbon cable assembly comprising a first set of elongated conductors and a second set of elongated conductors.

6. The audio headset of claim 5, wherein the first set of elongated conductors corresponds to the multiple elongated conductors.

7. The audio headset of claim 5, wherein each conductor of the first set of elongated conductors is spaced from an adjacent conductor by a first distance and each conductor of the second set of elongated conductors is spaced from an adjacent conductor by the first distance.

8. The audio headset of claim 7, wherein the substantially rectangular body has a third side and an opposing fourth side, and wherein the outermost conductor of the first set of elongated conductors is spaced from the third side of the substantially rectangular body by a second distance and the outermost conductor of the second set of elongated conductors is spaced from the fourth side of the substantially rectangular body by the second distance.

9. The audio headset of claim 8, wherein an innermost conductor of the first set of elongated conductors is spaced from an innermost conductor of the second set of elongated conductors by twice the second distance.

10. The audio headset of claim 5, wherein the first set of conductors and second set of conductors are arranged in a side-by-side relationship.

* * * * *